US009771768B2

(12) United States Patent
Lemm

(10) Patent No.: US 9,771,768 B2
(45) Date of Patent: Sep. 26, 2017

(54) SLIP RELEASE ASSEMBLY WITH CONE UNDERMINING FEATURE

(71) Applicant: BAKER HUGHES INCORPORATED, Houston, TX (US)

(72) Inventor: William C. Lemm, Sugar Land, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 387 days.

(21) Appl. No.: 14/609,124

(22) Filed: Jan. 29, 2015

(65) Prior Publication Data

US 2015/0292284 A1 Oct. 15, 2015

Related U.S. Application Data

(60) Provisional application No. 61/979,751, filed on Apr. 15, 2014.

(51) Int. Cl.
*E21B 23/01* (2006.01)
*E21B 33/129* (2006.01)

(52) U.S. Cl.
CPC ..... *E21B 23/01* (2013.01); *E21B 33/1291* (2013.01)

(58) Field of Classification Search
CPC ..... E21B 23/01; E21B 33/1291
See application file for complete search history.

(56) References Cited

U.S. PATENT DOCUMENTS 3,279,544 A 10/1966 Tausch et al.
3,352,362 A 11/1967 Lebourg
4,311,196 A 1/1982 Beall et al.
4,359,090 A 11/1982 Luke
4,436,150 A * 3/1984 Barker ..... E21B 33/134 166/123
4,573,537 A 3/1986 Hirasuna et al.
5,174,397 A 12/1992 Currington
5,273,109 A 12/1993 Arizmendi et al.
5,487,427 A 1/1996 Curington
5,701,954 A 12/1997 Kilgore et al.
5,727,632 A 3/1998 Richards
6,131,663 A 10/2000 Henley et al.
6,213,204 B1 4/2001 Doane
6,220,348 B1 4/2001 Serafin et al.
6,241,017 B1 6/2001 Doane et al.
6,629,563 B2 10/2003 Doane
6,827,150 B2 12/2004 Luke
7,051,805 B2 5/2006 Doane et al.
7,416,027 B2 8/2008 Ring et al.
8,186,446 B2 5/2012 Ingram et al.
8,205,671 B1 6/2012 Branton
8,291,989 B2 10/2012 Kilgore
(Continued)

FOREIGN PATENT DOCUMENTS

GB 2323869 A 10/1998

*Primary Examiner* — Robert E Fuller
*Assistant Examiner* — Steven MacDonald
(74) *Attorney, Agent, or Firm* — Mossman Kumar & Tyler PC

(57) ABSTRACT

A slip release mechanism provides for undermining the slip cone in the set position of the slips so that the grip of the slips can be released subsequent to allowing the cone ramp to flex. The slips can be pulled back down the cone ramp as the completion of the same motion that undermines the support for the cone.

12 Claims, 1 Drawing Sheet

(56) References Cited

U.S. PATENT DOCUMENTS

| | | | |
|---|---|---|---|
| 8,459,347 | B2 | 6/2013 | Stout |
| 8,534,368 | B2 | 9/2013 | Reimert et al. |
| 2011/0088891 | A1 | 4/2011 | Stout |

* cited by examiner

SLIP RELEASE ASSEMBLY WITH CONE UNDERMINING FEATURE

CROSS REFERENCE TO RELATED APPLICATION

This application is claims priority from U.S. Provisional Patent Application Ser. No. 61/979,751 for "Slip Release Assembly with Cone Undermining Feature", filed on Apr. 15, 2014, the disclosure of which is incorporated herein by reference in its entirety.

FIELD OF THE INVENTION

The field of the invention is slips for anchoring subterranean tools and more particularly a release device for the slips that features undermining the slip cone.

BACKGROUND OF THE INVENTION

Slips are typically extended by relative movement with respect to an adjacent cone. As the slip element rides up the cone it is moved radially toward a surrounding tubular. The leading face of each slip has a surface treatment commonly referred to as wickers which can be made of a hard material such as tungsten carbide or polycrystalline diamonds to enhance the bite of the slips into the surrounding tubular. Typically the wickers penetrate the inner wall of the pipe to facilitate the grip. Slips commonly anchor isolation devices such as packers and bridge plugs.

The common issue with slips is to get them to release especially after being set a very long time or after being exposed to extreme loading or operating conditions. Typically, force is applied to the slip element to try to pull the cone out from under the slip. Other designs apply a force to the slip to try to force the slip to ride down on the cone for a release of the wickers. Sometimes, especially after a long period of being in a set position and in a debris laden environment it becomes difficult to get the slips to release. Sometimes the slips refuse to fully release and a milling operation that is very expensive is needed to enable removal of the associated device.

Prior designs guide the slips at their edges to make sure they don't cock when being extended and to allow them to tangentially transfer radial loading when part of a continuous slip ring. Typical of some of the one piece slip arrangements are: U.S. Pat. No. 4,311,196; GB 2323869; U.S. Pat. No. 6,213,204; U.S. Pat. No. 5,487,427; U.S. Pat. No. 5,174,397; U.S. Pat. No. 3,279,544; and U.S. Pat. No. 6,241,017.

Still other designs focus on slip guidance and extension while using the traditional techniques for slip release. Such designs are: U.S. Pat. Nos. 7,416,027; 8,291,989; 4,359,090; 6,213,204; 6,131,663; 6,629,563; 5,701,954; 4,573,537; 8,459,347; 2011/0088891; 3,352,362; 5,273,109; 5,487,427; 5,727,632; 6,220,348; 6,827,150; 7,051,805; 8,186,446; 8,205,671 and 8,534,368.

These designs still present an issue of difficult release and the present invention presents a design to deal with this issue. The design features a two piece construction for the slip cone that lends support to the slip cone when the slips move out along the cone. For release, a piece is pulled out from under the cone to release the slip above the cone so that the slip can be easily retracted. These and other features of the present invention will be more readily apparent to those skilled in the art from a review of the description of the preferred embodiment and the associated drawings while recognizing that the full scope of the invention is to be determined from the appended claims.

SUMMARY OF THE INVENTION

A slip release mechanism provides for undermining the slip cone in the set position of the slips so that the grip of the slips can be released subsequent to allowing the cone ramp to flex. The slips can be pulled back down the cone ramp as the completion of the same motion that undermines the support for the cone.

DETAILED DESCRIPTION OF THE PREFERRED EMBODIMENT

Figure 1:
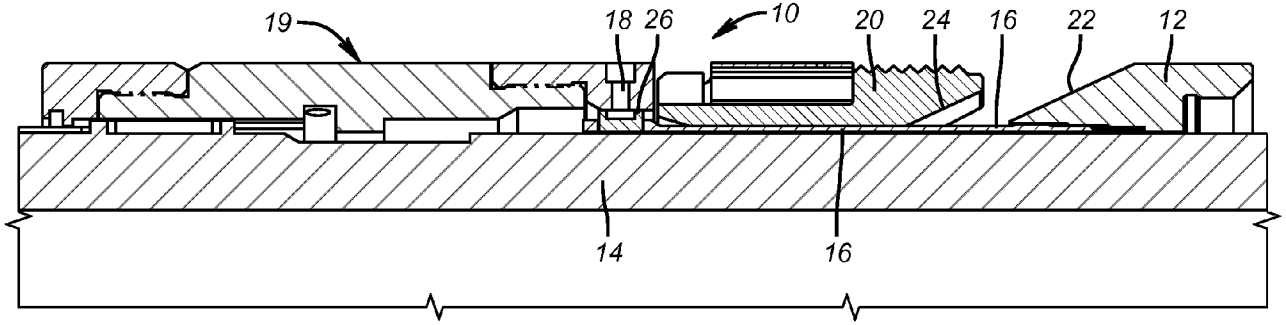
FIG. 1 is a section view in the run in position.

Referring to FIG. 1 the slip assembly 10 is shown in the run in position. Cone 12 is supported from mandrel 14 by sleeve 16. Sleeve 16 is initially held to the outer assembly 19. Outer assembly 19 holds the slips 20 against axial movement when the cone 12, sleeve 16 and retainer 26 move up axially with respect to the mandrel 14 for the set position shown in FIG. 2. Ramp 22 on the cone 12 engages ramp 24 on the slips 20 as the slips 20 move out radially to engage the surrounding tubular for the set position.

Figure 2:
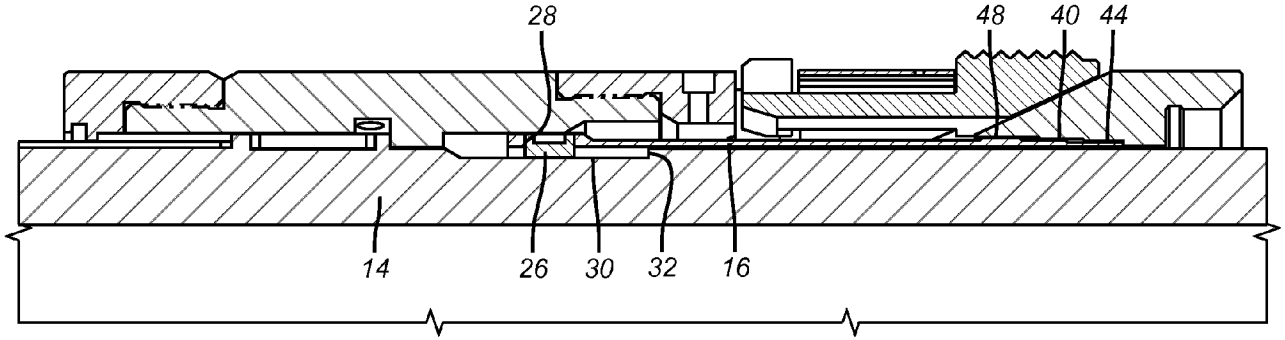
FIG. 2 is the view of FIG. 1 in the set position.
Figure 3:
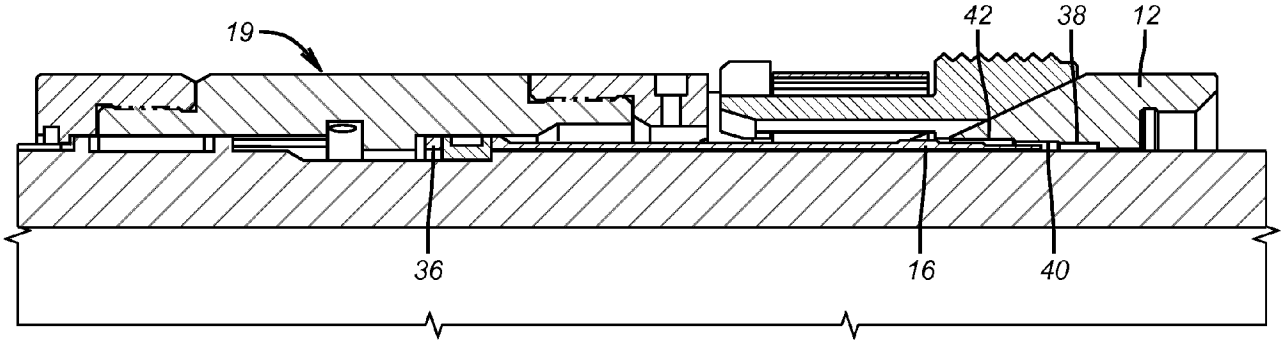
FIG. 3 is the view of FIG. 2 in the released position.

As seen in FIG. 2 the upward movement of the cone 12 takes with it sleeve 16 as the shear device 18 breaks. A retainer 26 sits in an opening 28 of the sleeve 16. When the shear device 18 breaks and the set position of FIG. 2 is reached, the retainer 26 is no longer retained by the now broken shear device 18. Retainer 26 is now able to fall radially inwardly into groove 30. Groove 30 has a retrieval surface 32 at its lower end designed to engage retainer 26 for undermining the cone 12 by pulling out the sleeve 16 out from under it as shown in FIG. 3. The parts are proportioned so that the sleeve 16 is first removed from under cone 12 before further picking up of mandrel 14 engages outer assembly 19 to pull the slips 12 down ramp 22 of the cone 12 for the fully released position.

Those skilled in the art will appreciate that by initially undermining the cone with the slips extended, the slips are no longer wedged against the surrounding tubular and as a follow on movement can be retracted down the ramp that defines the cone. The sleeve 16 may engage the cone on a single or multiple surfaces 38, 40 and 42 with substantially parallel surfaces 44, 46 and 48 respectively. These surfaces can be parallel to the axis of the mandrel as illustrated in the drawing or at a skew to the mandrel 14 axis. The end of sleeve 16 can be a complete cylindrical shape or can have cutouts or slots to make retraction shown in FIG. 3 simpler. The cone 12 can also be a 360 degree ramp or can have cutouts or slots to the end or on the ramp for the same reason. The sleeve and associated cone can have similar or dissimilar features designed to facilitate release of sleeve 16 from under the cone 12. Other alternatives are contemplated such as a change in shape for the sleeve 16 in response to well conditions. One example is to use a shape memory alloy for the sleeve 16 that responds to added heat to reduce in thickness to facilitate removal.

The above description is illustrative of the preferred embodiment and many modifications may be made by those skilled in the art without departing from the invention whose scope is to be determined from the literal and equivalent scope of the claims below:

I claim:

1. A fixation assembly for a subterranean tool, comprising:

a mandrel;

at least one slip assembly mounted to said mandrel;

a cone mounted to said mandrel for selectively guiding said slip assembly radially away from said mandrel, said cone selectively collapsible toward said mandrel when said slip assembly is engaged to a surrounding tubular to facilitate release of grip by said slip assembly from the surrounding tubular, said release of grip accomplished by breaking a breakable member, on a support sleeve connecting said support sleeve to said at least one slip assembly, as said at least one slip assembly moves radially away from said mandrel thereby allowing initial registry of said support sleeve with said mandrel for subsequent movement of said support sleeve away from between said cone and said mandrel as said at least one slip assembly releases grip.

2. The assembly of claim 1, wherein:

said cone further comprising at least a first and a second radially stacked components.

3. The assembly of claim 2, wherein:

said first and said second components are relatively movable.

4. The assembly of claim 3, wherein:

said mandrel engaging said second component to translate said second component axially away from said first component that comprises a tapered surface for engaging said slip assembly.

5. The assembly of claim 4, wherein:

said mandrel movable axially for a predetermined distance before engaging said second component for tandem movement.

6. The assembly of claim 2, wherein:

said second component initially secured to said slip assembly with a breakable member.

7. The assembly of claim 6, wherein:

a broken portion of said breakable member enters a recess on said mandrel to facilitate tandem axial movement of said mandrel and said second component.

8. The assembly of claim 1, wherein:

said cone comprising an undercut facing said mandrel that is selectively occupied by said a support sleeve.

9. The assembly of claim 8, wherein:

said support sleeve disposed in said undercut as said slip assembly moves away from said mandrel on a tapered surface of said cone.

10. The assembly of claim 9, wherein:

said mandrel selectively removing said support sleeve from said undercut for grip release by said slip assembly in response to flexing of said cone, enabled by movement of said sleeve.

11. The assembly of claim 1, wherein:

a portion of said sheared breakable member engages a recess in said mandrel.

12. The assembly of claim 11, wherein:

tandem movement of said mandrel and support sleeve using said sheared breakable member positioned in said recess removes said support sleeve from said undercut.

* * * * *